US008869569B2

(12) United States Patent
Kappler

(10) Patent No.: US 8,869,569 B2
(45) Date of Patent: Oct. 28, 2014

(54) CLOTHES WASHER DEMAND RESPONSE WITH AT LEAST ONE ADDITIONAL SPIN CYCLE

(75) Inventor: Jerrod Aaron Kappler, Louisville, KY (US)

(73) Assignee: General Electric Company, Schenectady, NY (US)

( * ) Notice: Subject to any disclaimer, the term of this patent is extended or adjusted under 35 U.S.C. 154(b) by 98 days.

(21) Appl. No.: 12/899,986

(22) Filed: Oct. 7, 2010

(65) Prior Publication Data

US 2011/0061177 A1 Mar. 17, 2011

Related U.S. Application Data

(63) Continuation-in-part of application No. 12/559,751, filed on Sep. 15, 2009, now Pat. No. 8,627,689.

(51) Int. Cl.

| | |
|---|---|
| ***D06F 33/02*** | (2006.01) |
| ***D06F 35/00*** | (2006.01) |
| ***D06F 39/00*** | (2006.01) |

(52) U.S. Cl.

CPC ..... *D06F 33/02* (2013.01); *D06F 35/007* (2013.01); *D06F 39/006* (2013.01)

USPC ..... 68/12.12; 68/12.14; 68/20

(58) Field of Classification Search

CPC ..... D06F 33/02; D06F 35/007; D06F 39/006; D06F 58/28

USPC ..... 8/158; 68/12.02, 12.12, 12.14, 12.15, 68/12.16, 19, 19.1, 19.2, 20, 27

See application file for complete search history.

(56) References Cited

U.S. PATENT DOCUMENTS

| | | | |
|---|---|---|---|
| 2,545,054 | A | 3/1951 | Stitz |
| 3,683,343 | A | 8/1972 | Feldman et al. |
| 3,720,073 | A | 3/1973 | McCarty |
| 4,048,812 | A | 9/1977 | Thomason |
| 4,167,786 | A | 9/1979 | Miller et al. |

(Continued)

FOREIGN PATENT DOCUMENTS

| | | | |
|---|---|---|---|
| CN | 1692317 | A | 11/2005 |
| CN | 101013979 | A | 8/2007 |

(Continued)

OTHER PUBLICATIONS

PCT/US2009/056919 International Search Report.

(Continued)

*Primary Examiner* — Joseph L Perrin

(74) *Attorney, Agent, or Firm* — Global Patent Operation; Marc A. Vivenzio

(57) ABSTRACT

A clothes washer is provided comprising one or more power consuming functions and a controller in signal communication with an associated utility. The controller can receive and process a signal from the associated utility indicative of current state of an associated utility. The controller operates the clothes washer in one of a plurality of operating modes, including at least a normal operating mode and an energy savings mode in response to the received signal. The controller is configured to change the power consuming functions by modifying the spin cycle to achieve a lower remaining moisture content in the clothes load prior to going into a dryer, thus reducing overall total energy consumption to completely wash and dry a clothes load.

3 Claims, 5 Drawing Sheets

SYSTEM DIAGRAM

(56) References Cited

U.S. PATENT DOCUMENTS 4,190,756 A 2/1980 Foerstner
4,216,658 A 8/1980 Baker et al.
4,247,786 A 1/1981 Hedges
4,362,970 A 12/1982 Grady
4,454,509 A 6/1984 Buennagel et al.
4,637,219 A 1/1987 Grose
4,659,943 A 4/1987 Virant
4,718,403 A 1/1988 McCall
4,731,547 A 3/1988 Alenduff et al.
4,841,281 A 6/1989 Melvin, Jr.
4,903,502 A 2/1990 Hanson et al.
4,926,837 A 5/1990 Parker et al.
4,998,024 A 3/1991 Kirk et al.
5,040,724 A 8/1991 Brinkruff et al.
5,137,041 A 8/1992 Hall et al.
5,183,998 A 2/1993 Hoffman et al.
5,220,807 A 6/1993 Bourne et al.
5,224,355 A 7/1993 So et al.
5,230,467 A 7/1993 Kubsch et al.
5,289,362 A 2/1994 Liebl et al.
5,408,578 A 4/1995 Bolivar
5,430,430 A 7/1995 Gilbert
5,451,843 A 9/1995 Kahn et al.
5,462,225 A 10/1995 Massara et al.
5,479,157 A 12/1995 Suman et al.
5,479,558 A 12/1995 White et al.
5,481,140 A 1/1996 Maruyama et al.
5,488,565 A 1/1996 Kennon et al.
5,495,551 A 2/1996 Robinson et al.
5,504,306 A 4/1996 Russell et al.
5,505,377 A 4/1996 Weiss
5,515,692 A 5/1996 Sterber et al.
5,574,979 A 11/1996 West
5,581,132 A 12/1996 Chadwick
5,635,895 A 6/1997 Murr
5,706,191 A 1/1998 Bassett et al.
5,761,083 A 6/1998 Brown et al.
5,805,856 A 9/1998 Hanson
5,816,491 A 10/1998 Berkeley et al.
5,866,880 A 2/1999 Seitz et al.
5,874,902 A 2/1999 Heinrich et al.
5,880,536 A 3/1999 Mardirossian
5,883,802 A * 3/1999 Harris ..... 700/28
5,886,647 A 3/1999 Badger et al.
5,926,776 A 7/1999 Glorioso et al.
5,937,942 A 8/1999 Bias et al.
5,956,462 A 9/1999 Langford
6,018,150 A 1/2000 Maher
6,026,651 A 2/2000 Sandelman
6,080,971 A 6/2000 Seitz
6,118,099 A 9/2000 Lake
6,144,161 A 11/2000 Kimmich et al.
6,179,213 B1 1/2001 Gibino et al.
6,185,483 B1 2/2001 Drees
6,229,433 B1 5/2001 Rye et al.
6,246,831 B1 6/2001 Seitz et al.
6,380,866 B1 4/2002 Sizer et al.
6,400,103 B1 6/2002 Adamson
6,480,753 B1 11/2002 Calder et al.
6,489,597 B1 12/2002 Hornung
6,553,595 B1 4/2003 Bruntz et al.
6,631,622 B1 10/2003 Ghent et al.
6,694,753 B1 2/2004 Lanz et al.
6,694,927 B1 2/2004 Pouchak et al.
6,704,401 B2 3/2004 Piepho et al.
6,778,868 B2 8/2004 Imamura et al.
6,784,872 B1 8/2004 Matsui et al.
6,806,446 B1 10/2004 Neale
6,817,195 B2 11/2004 Rafalovich et al.
6,828,695 B1 12/2004 Hansen
6,860,431 B2 3/2005 Jayadev
6,872,919 B2 3/2005 Wakefield et al.
6,873,876 B1 3/2005 Aisa
6,879,059 B2 4/2005 Sleva
6,904,385 B1 6/2005 Budike
6,922,598 B2 7/2005 Lim et al.
6,943,321 B2 9/2005 Carbone et al.
6,961,642 B2 11/2005 Horst
6,983,210 B2 1/2006 Matsubayashi et al.
7,010,363 B2 3/2006 Donnelly et al.
7,039,575 B2 5/2006 Juneau
7,043,380 B2 5/2006 Rodenberg et al.
7,053,790 B2 5/2006 Jang et al.
7,057,140 B2 6/2006 Pittman
7,069,090 B2 6/2006 Huffington et al.
7,082,380 B2 7/2006 Wiebe et al.
7,110,832 B2 9/2006 Ghent
7,155,305 B2 12/2006 Hayes et al.
7,164,851 B2 1/2007 Sturm et al.
7,206,670 B2 4/2007 Pimputkar et al.
7,266,962 B2 9/2007 Montuoro et al.
7,274,973 B2 9/2007 Nichols et al.
7,274,975 B2 9/2007 Miller et al.
7,368,686 B2 5/2008 Etheredge et al.
7,372,002 B2 5/2008 Nakamura et al.
7,420,140 B2 9/2008 Lenhart et al.
7,420,293 B2 9/2008 Donnelly et al.
7,446,646 B2 11/2008 Huomo
7,478,070 B2 1/2009 Fukui et al.
7,541,941 B2 6/2009 Bogolea et al.
7,561,977 B2 7/2009 Horst et al.
7,565,813 B2 7/2009 Pouchak
7,685,849 B2 3/2010 Worthington
7,720,035 B2 5/2010 Oh et al.
7,751,339 B2 7/2010 Melton et al.
7,783,390 B2 8/2010 Miller
7,919,729 B2 4/2011 Hsu
7,925,388 B2 4/2011 Ying
7,962,248 B2 6/2011 Flohr
7,991,513 B2 8/2011 Pitt
8,024,073 B2 9/2011 Imes et al.
8,027,752 B2 9/2011 Castaldo et al.
8,033,686 B2 10/2011 Recker et al.
8,094,037 B2 1/2012 Unger
8,185,252 B2 5/2012 Besore
8,190,302 B2 5/2012 Burt et al.
8,355,748 B2 1/2013 Abe et al.
8,367,984 B2 2/2013 Besore et al.
2001/0025349 A1 9/2001 Sharood et al.
2001/0048361 A1 12/2001 Mays et al.
2002/0024332 A1 2/2002 Gardner
2002/0071689 A1 6/2002 Miyamoto
2002/0125246 A1 9/2002 Cho et al.
2002/0175806 A1 11/2002 Marneweck et al.
2002/0196124 A1 12/2002 Howard et al.
2002/0198629 A1 12/2002 Ellis
2003/0036820 A1 2/2003 Yellepeddy et al.
2003/0043845 A1 3/2003 Lim et al.
2003/0178894 A1 9/2003 Ghent
2003/0193405 A1 10/2003 Hunt et al.
2003/0194979 A1 10/2003 Richards et al.
2003/0233201 A1 12/2003 Horst et al.
2004/0024483 A1 2/2004 Holcombe
2004/0034484 A1 2/2004 Solomita et al.
2004/0098171 A1 5/2004 Horst
2004/0100199 A1 5/2004 Yang
2004/0107510 A1 6/2004 Buckroyd et al.
2004/0112070 A1 6/2004 Schanin
2004/0117330 A1 6/2004 Ehlers et al.
2004/0118008 A1* 6/2004 Jeong et al. ..... 34/425
2004/0128266 A1 7/2004 Yellepeddy et al.
2004/0133314 A1 7/2004 Ehlers et al.
2004/0139038 A1 7/2004 Ehlers et al.
2004/0254654 A1* 12/2004 Donnelly et al. ..... 700/22
2005/0011205 A1 1/2005 Holmes et al.
2005/0134469 A1 6/2005 Odorcic et al.
2005/0138929 A1 6/2005 Enis et al.
2005/0173401 A1 8/2005 Bakanowski et al.
2005/0184046 A1 8/2005 Sterling
2005/0190074 A1 9/2005 Cumeralto et al.
2006/0031180 A1 2/2006 Tamarkin et al.
2006/0036338 A1 2/2006 Harkcom et al.
2006/0068728 A1 3/2006 Ishidoshiro et al.
2006/0095164 A1 5/2006 Donnelly et al.

(56) References Cited

U.S. PATENT DOCUMENTS

| | | | | |
|---|---|---|---|---|
| 2006/0123807 | A1 | 6/2006 | Sullivan et al. | |
| 2006/0159043 | A1 | 7/2006 | Delp et al. | |
| 2006/0162973 | A1 | 7/2006 | Harris et al. | |
| 2006/0190139 | A1 | 8/2006 | Reaume et al. | |
| 2006/0208570 | A1 | 9/2006 | Christian et al. | |
| 2006/0259547 | A1 | 11/2006 | Bogatin et al. | |
| 2006/0272830 | A1 | 12/2006 | Fima et al. | |
| 2006/0276938 | A1 | 12/2006 | Miller | |
| 2006/0289436 | A1 | 12/2006 | Carbone et al. | |
| 2007/0005195 | A1 | 1/2007 | Pasquale et al. | |
| 2007/0008076 | A1 | 1/2007 | Rodgers et al. | |
| 2007/0030116 | A1 | 2/2007 | Feher | |
| 2007/0043478 | A1 | 2/2007 | Ehlers et al. | |
| 2007/0136217 | A1 | 6/2007 | Johnson et al. | |
| 2007/0151311 | A1 | 7/2007 | McAllister et al. | |
| 2007/0185675 | A1 | 8/2007 | Papamichael et al. | |
| 2007/0203860 | A1 | 8/2007 | Golden et al. | |
| 2007/0213880 | A1 | 9/2007 | Ehlers | |
| 2007/0220907 | A1 | 9/2007 | Ehlers | |
| 2007/0229236 | A1 | 10/2007 | Mercer et al. | |
| 2007/0271006 | A1* | 11/2007 | Golden et al. | 700/295 |
| 2007/0276547 | A1 | 11/2007 | Miller | |
| 2008/0029081 | A1 | 2/2008 | Gagas et al. | |
| 2008/0034768 | A1 | 2/2008 | Pimentel et al. | |
| 2008/0083729 | A1 | 4/2008 | Etheredge et al. | |
| 2008/0106147 | A1 | 5/2008 | Caggiano et al. | |
| 2008/0120790 | A1 | 5/2008 | Ashrafzadeh | |
| 2008/0122585 | A1 | 5/2008 | Castaldo et al. | |
| 2008/0136581 | A1 | 6/2008 | Heilman et al. | |
| 2008/0144550 | A1 | 6/2008 | Makhlouf et al. | |
| 2008/0167756 | A1 | 7/2008 | Golden et al. | |
| 2008/0167931 | A1 | 7/2008 | Gerstemeier et al. | |
| 2008/0172312 | A1 | 7/2008 | Synesiou et al. | |
| 2008/0177678 | A1 | 7/2008 | Di Martini et al. | |
| 2008/0179052 | A1 | 7/2008 | Kates | |
| 2008/0204240 | A1 | 8/2008 | Hilgers et al. | |
| 2008/0215263 | A1 | 9/2008 | Flohr | |
| 2008/0258633 | A1 | 10/2008 | Voysey | |
| 2008/0272934 | A1 | 11/2008 | Wang et al. | |
| 2008/0277487 | A1 | 11/2008 | Mueller et al. | |
| 2009/0006878 | A1 | 1/2009 | Borghetti et al. | |
| 2009/0038369 | A1 | 2/2009 | Vondras | |
| 2009/0063257 | A1 | 3/2009 | Zak et al. | |
| 2009/0105888 | A1 | 4/2009 | Flohr et al. | |
| 2009/0146838 | A1 | 6/2009 | Katz | |
| 2009/0171862 | A1 | 7/2009 | Harrod et al. | |
| 2009/0235675 | A1 | 9/2009 | Chang et al. | |
| 2009/0240381 | A1 | 9/2009 | Lane | |
| 2009/0254396 | A1 | 10/2009 | Metcalfe | |
| 2009/0326728 | A1 | 12/2009 | Chrisop et al. | |
| 2010/0017242 | A1 | 1/2010 | Hamilton et al. | |
| 2010/0070091 | A1 | 3/2010 | Watson et al. | |
| 2010/0092625 | A1 | 4/2010 | Finch et al. | |
| 2010/0131117 | A1* | 5/2010 | Mattiocco et al. | 700/295 |
| 2010/0175719 | A1 | 7/2010 | Finch et al. | |
| 2010/0179708 | A1 | 7/2010 | Watson et al. | |
| 2010/0262963 | A1 | 10/2010 | Wassermann et al. | |
| 2010/0301774 | A1 | 12/2010 | Chemel et al. | |
| 2011/0001438 | A1 | 1/2011 | Chemel et al. | |
| 2011/0062142 | A1 | 3/2011 | Steurer | |
| 2011/0085287 | A1 | 4/2011 | Ebrom et al. | |
| 2011/0087382 | A1 | 4/2011 | Santacatterina et al. | |
| 2011/0095017 | A1 | 4/2011 | Steurer | |
| 2011/0106328 | A1 | 5/2011 | Zhou et al. | |
| 2011/0114627 | A1 | 5/2011 | Burt | |
| 2011/0123179 | A1 | 5/2011 | Roetker et al. | |
| 2011/0148390 | A1 | 6/2011 | Burt et al. | |
| 2011/0153106 | A1 | 6/2011 | Drake et al. | |
| 2011/0181114 | A1 | 7/2011 | Hodges et al. | |
| 2011/0290781 | A1 | 12/2011 | Burt et al. | |
| 2012/0054123 | A1 | 3/2012 | Broniak et al. | |

FOREIGN PATENT DOCUMENTS

| | | | |
|---|---|---|---|
| EP | 1496324 | A1 | 1/2005 |
| GB | 2105127 | A | 3/1983 |
| JP | 11313441 | A2 | 11/1999 |
| KR | 20060085711 | A | 7/2006 |
| WO | 86/00976 | A1 | 2/1986 |
| WO | 90/12261 | A1 | 10/1990 |
| WO | 98/48335 | A1 | 10/1998 |
| WO | 2007/060059 | A1 | 5/2007 |
| WO | 2007136456 | A2 | 11/2007 |

OTHER PUBLICATIONS

Search Report from CN Application No. 201010135268.8 dated Oct. 24, 2012.

International Search Report from PCT Application No. PCT/US2009/056878, Nov. 17, 2009.

International Search Report from PCT Application No. PCT/US2009/056882, Nov. 4, 2009.

International Search Report from PCT Application No. PCT/US2009/056883, Oct. 26, 2009.

International Search Report from PCT Application No. PCT/US2009/056886, Nov. 5, 2009.

International Search Report from PCT Application No. PCT/US2009/056889, Nov. 10, 2009.

International Search Report from PCT Application No. PCT/US2009/056894, Nov. 13, 2009.

International Search Report from PCT Application No. PCT/US2009/056895, Nov. 9, 2009.

International Search Report from PCT Application No. PCT/US2009/056901, Nov. 10, 2009.

International Search Report from PCT Application No. PCT/US2009/056906, Nov. 10, 2009.

International Search Report from PCT Application No. PCT/US2009/056913, Nov. 10, 2009.

International Search Report from PCT Application No. PCT/US2009/056914, Nov. 2, 2009.

Search Report from EP Application No. 10153695.1, May 24, 2012.

Real-Time Feedback, Natural Resources Canada via website www.nrcan.gc.ca , 2008, http://oee.nrcan.gc.ca/publications/equipment/10918.

International Search Report from PCT Application No. PCT/US2009/056911, Mar. 10, 2010.

Lemay et al., An Integrated Architecture for Demand Response Communications and Control, University of Illinois Urbana-Champaign, Oct. 28, 2008.

Weisstein, Eric W. "At Least One.", From MathWorld—A Wolfram Web Resource. http://mathworld.wolfram.com/AtLeastOne.html, p. 1.

* cited by examiner

CLOTHES WASHER DEMAND RESPONSE WITH AT LEAST ONE ADDITIONAL SPIN CYCLE

CROSS REFERENCE TO RELATED APPLICATIONS

The present application is a continuation-in-part application and claims priority from U.S. patent application Ser. No. 12/559,751, filed 15 Sep. 2009 U.S. Pat. No. 8,627,689, which application is expressly incorporated herein by reference in its entirety.

BACKGROUND OF THE DISCLOSURE

This disclosure relates to energy management, and more particularly to energy management of household consumer appliances. The present disclosure finds particular application to energy management of a clothes washer appliance, and is also referred to as a clothes washer demand response.

Currently, utilities charge a flat rate. Increasing costs of fuel prices and high energy use during certain parts of the day make it highly likely that utilities will begin to require customers to pay a higher rate during peak demand. Accordingly, a potential cost savings is available to the homeowner by managing energy use of various household appliances, particularly during the peak demand periods. As is taught in the cross-referenced applications, a controller is configured to receive and process a signal, typically from a utility, indicative of a current cost of supplied energy. The controller is configured to change the operation of an appliance from a normal mode (e.g., when the demand and cost of the energy is lowest) to an energy savings mode (which can be at various levels, e.g., medium, high, critical). Thus, various responses are desired in an effort to reduce energy consumption and the associated cost.

More particularly, the parent application noted above generally teaches adjusting operation schedule, an operation delay, an operation adjustment and a select deactivation on at least one or more power consuming features or functions to reduce power consumption of the clothes washer in the energy savings mode. For example, the operation delay may include a delay in start time, an extension of time to a delayed start, pausing an existing cycle, delaying a restart or any combination of these examples. A need exists for providing alternative courses of operation in a peak demand state where a consumer's flexibility and convenience is maximized during peak pricing events.

SUMMARY OF THE DISCLOSURE

A clothes washer includes a housing that receives a drum mounted for selected rotation relative to the housing. A controller receives and processes a signal indicative of the current cost of supplied energy. The controller operates the clothes washer in one of a plurality of operating modes, including a normal mode and an energy savings mode, based on the received signal. The controller is configures to modify a spin profile of the drum in response to a signal representing the energy savings mode.

The controller modifies the drum spin profile by adding at least one additional spin cycle in the energy savings mode to the number of spin cycles used in the normal mode.

The controller signals the drum to tumble and/or agitate the laundry items at least one additional time before the at least one additional spin cycle. In one embodiment of the energy savings mode, the tumbling and/or agitation action is increased, for example, adding a tumbling and/or agitation cycle after completion of the final rinse cycle spin in the normal mode, whereby this additional tumbling and/or agitation cycle is followed by yet another spin dry segment.

In another embodiment of the energy savings mode, the controller signals the drum to eliminate one of the multiple spin cycles before the rinse portion of the cycle. The controller subsequently signals the drum to add an additional spin cycle after the rinse cycle.

A method of operating a clothes washer includes a controller adapted to receive and process a signal indicative of the current cost of supplied energy, and in response, operating the clothes washer in a normal mode or an energy savings mode based on the received signal. The controller modifies operation of the drum that either spins or tumbles/agitates, while the controller adds at least one additional spin cycle in the energy savings mode to reduce remaining moisture content in the laundry load. This allows the less moisture to be heat dried out of the load when placed into the dryer. Thus, the overall energy required to wash and dry the load is less since the washer is more efficient in extracting water from the load then the dryer.

A controller may also include an additional tumble/agitation cycle before the additional spin cycles in the energy savings mode. This allows the clothes load to be mixed up and replastered to the basket wall during a subsequent spin dry segment.

The present disclosure reduces the average power used by the clothes washer during peak pricing times, and/or reduces overall average power used by the clothes washer and dryer during peak pricing times.

The present arrangement saves on costs, and adds convenience and flexibility for the consumer to deal with pricing events.

Still another benefit resides in completing the cycle faster while still shedding electrical load without having to pause or delay the cycle entirely.

Selected ones of the solutions are easy to execute, i.e., requiring only software changes to the clothes washer operation based on signals received.

Still other benefits and advantages of this disclosure will become more apparent upon reading and understanding the following detailed description.

DETAILED DESCRIPTION OF THE PREFERRED EMBODIMENTS

Figure 1:
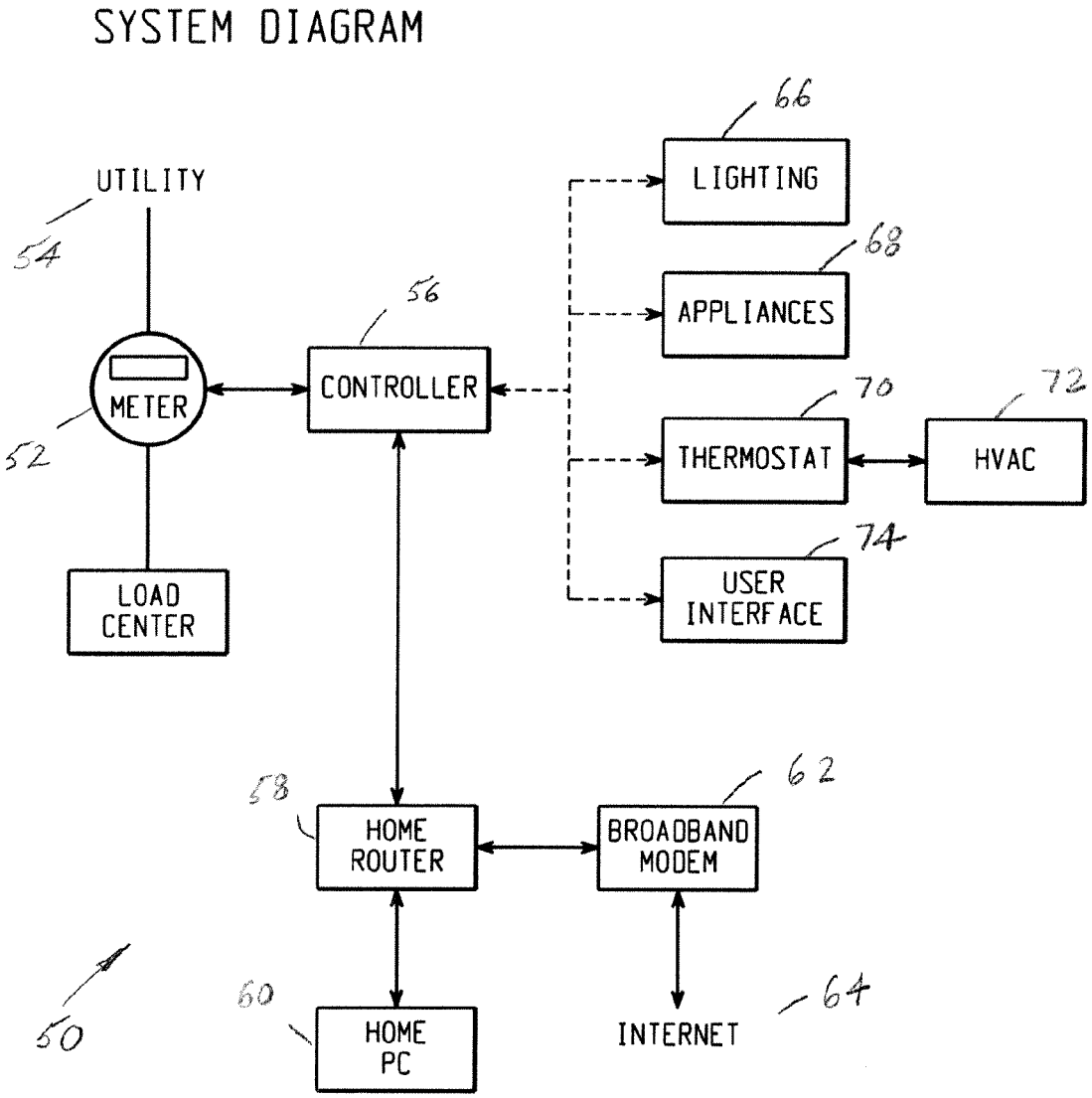
FIG. 1 is a schematic representation of an exemplary demand managed home including appliances such as a clothes washer.

FIG. 1 shows a general system diagram 50 of a utility meter 52 that communicates with utility 54 and a controller 56 that receives and processes a signal from the meter. The occurrence of peak demand and demand limit data may be communicated by the utility and through the meter to the controller. The demand limit can be set by the homeowner or consumer in some instances. Additionally, the homeowner can choose to force various modes in the appliance control based on the rate that the utility is charging. The controller may interact with a home router 58, home PC 60, broadband modem 62 or the internet 64. Preferably, the controller 56 is configured to control various items in the home, such as the lighting 66, one or more appliances 68 (including a clothes washer), the thermostat and HVAC 70, 72, respectively, and may include a user interface 74 that displays information for the homeowner and allows the homeowner to program the controller or override selected functions if so desired. This system is generally shown and described in commonly owned U.S. patent application Ser. No. 12/559,703, filed Sep. 15, 2009.

Figure 2:
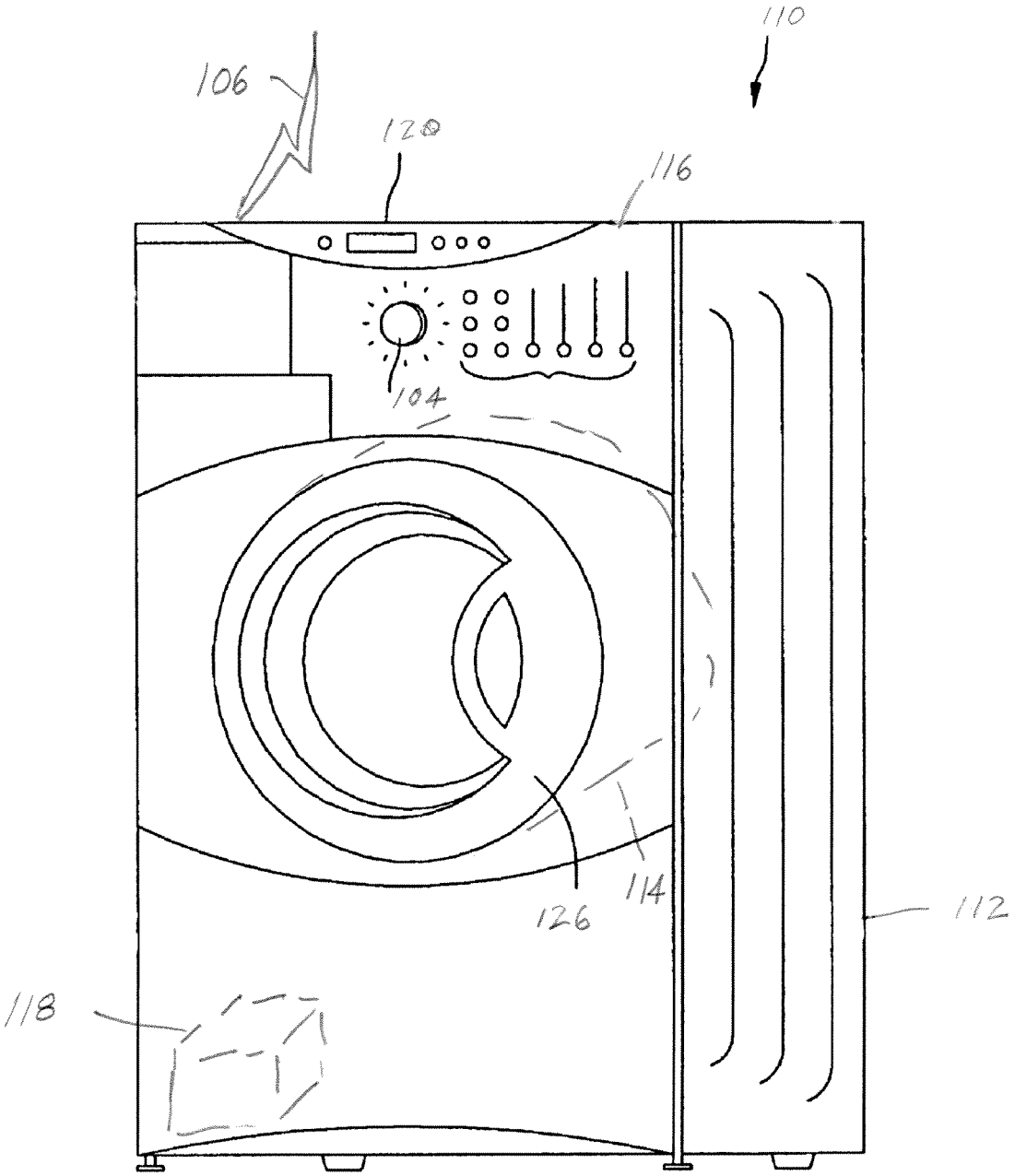
FIG. 2 is a perspective view of a clothes washer.

An exemplary embodiment of a demand managed appliance 100 is clothes washer 110 schematically illustrated in FIG. 2. The clothes washer 110 comprises at least one power consuming feature/function and a controller 104 operatively associated with the power consuming feature/function. The controller 104 can include a micro computer on a printed circuit board which is programmed to selectively control the energization of the power consuming feature/function. The controller 104 is configured to receive and process a signal 106 indicative of a utility state, for example, availability and/or current cost of supplied energy. The energy signal may be generated by a utility provider, such as a power company, and can be transmitted via a power line, as a radio frequency signal, or by any other means for transmitting a signal when the utility provider desires to reduce demand for its resources. The cost can be indicative of the state of the demand for the utility's energy, for example a relatively high price or cost of supplied energy is typically associated with a peak demand state or period and a relative low price or cost is typically associated with an off-peak demand state or period.

The controller 104 can operate the clothes washer 110 in one of a plurality of operating modes, including a normal operating mode and an energy savings mode, in response to the received signal. Specifically, the clothes washer 110 can be operated in the normal mode in response to a signal indicating an off-peak demand state or period and can be operated in an energy savings mode in response to a signal indicating a peak demand state or period. As will be discussed in greater detail below, the controller 104 is configured to at least selectively adjust and/or disable the power consuming feature/function to reduce power consumption of the clothes washer 110 in the energy savings mode.

The clothes washer 110 generally includes an outer case or housing 112 and a control panel or user interface 116. The clothes washer further includes a lid pivotally mounted in the top wall. Though not shown in the drawings, clothes washer 110 includes within outer case 112, for example, a wash tub and/or wash basket 114 disposed for receiving clothes items to be washed, a drive system or motor 118 operatively connected to the controller and the basket 114 to tumble and/or agitate the wash load (also referred to herein as mechanical action) during wash and rinse cycles and spinning the basket during spin cycles, and a liquid distribution system comprising a water valve, for delivering water to the tub and basket and a pump for removing liquid from the tub, all of which may be of conventional design. Controller 104 is configured with a plurality of clothes washing algorithms preprogrammed in the memory to implement user selectable cycles for washing a variety of types and sizes of clothes loads. Each such cycle comprises a combination of pre-wash, wash, rinse, and spin sub-cycles. Each sub-cycle is a power consuming feature/function involving energization of a motor or other power consuming components. The amount of energy consumed by each cycle depends on the nature, number and duration of each of the sub-cycles comprising the cycle. The user interface 116 can include a display 120 and control buttons for enabling the user to make various operational selections. Instructions and selections are typically displayed on the display 120. The clothes washer further includes a door 126 to insert and removes clothes from the wash tub 114. Clothes washing algorithms can be preprogrammed in the memory accessed by the controller for many different types of cycles.

One response to a peak demand state is to delay operation, reschedule operation for a later start time, and/or alter one or more of selected functions/features in order to reduce energy demands. For example, clothes washers have the capacity to run at off-peak hours because demand is either not constant and/or the functions are such that immediate response is not necessary. However, a cost savings associated with reduced energy use during a peak demand period when energy costs are elevated must be evaluated with convenience for the consumer/homeowner. As one illustrative example, the clothes washer 110 that has been loaded during the daytime, i.e., typical peak demand period hours, can be programmed to delay operations for a later, albeit off-peak demand hours.

In order to reduce the peak energy consumed by a clothes washer, modifications and/or delays of individual clothes washer cycles can be adjusted in order to reduce the total and/or instantaneous energy consumed. Reducing total and/or instantaneous energy consumed also encompasses reducing the energy consumed at peak times and/or reducing the overall electricity demands during peak times and non-peak times.

In conjunction with the scheduling delays described above, or as separate operational changes, the following operation adjustments can be selected in order to reduce energy demands. The operation adjustments to be described hereinafter, can be implemented in conjunction with off-peak mode hours and/or can be implemented during on-peak mode hours. Associated with a clothes washer, the operational adjustments can include one or more of the following: a reduction in operating temperature (i.e. temperature set point adjustments) in one or more cycles, a disablement of one or more heaters in one or more cycles, reduction in power to one or more heaters, a switch from a selected cycle to a reduced power consumption cycle, a reduction in a duration of cycle time in one or more cycles, a disablement of one or more cycles, a skipping of one or more cycles, a reduction of water volume and/or water temperature in one or more cycles, and an adjustment to the wash additives (i.e., detergent, fabric softener, bleach, etc.) in one or more cycles. Illustratively, a switch from a selected cycle to a reduced power consumption cycle could include a change to the cycle definition when a command is received. For example, if a customer/user pushes "heavy duty wash" cycle, the selected cycle would then switch to a "regular" cycle, or the customer/user pushes "normal" cycle which would then switch to a "permanent press" cycle. As described, the switching is in response to lowering the energy demands from a selected cycle to a reduced power consumption cycle that meets a similar functional cycle.

Figure 3:
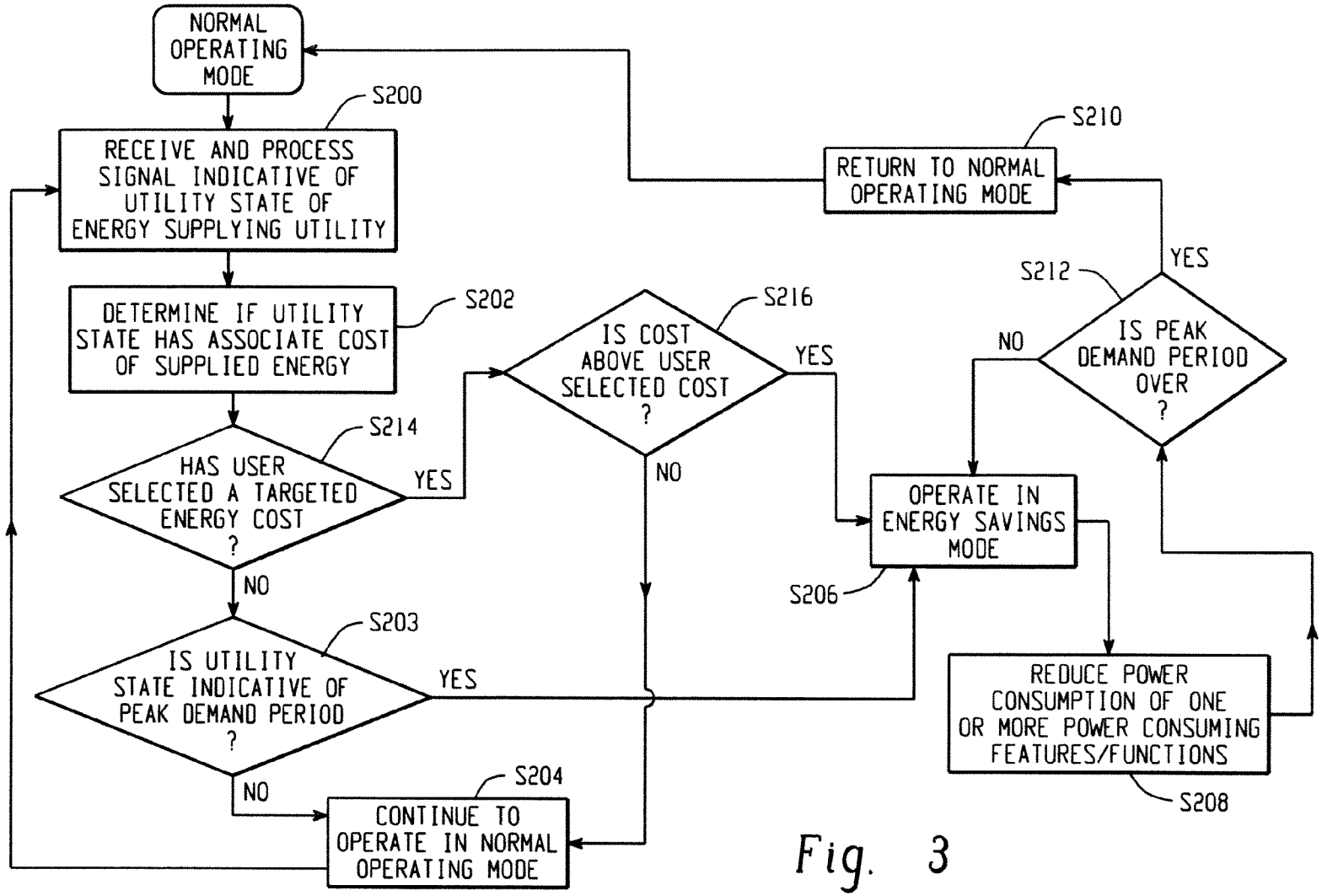
FIG. 3 is a flowchart that generally illustrates the logic associated with a demand managed appliance.

With reference to FIG. 3, a control method in accordance with the present disclosure comprises communicating with an associated utility and receiving and processing the signal indicative of cost of supplied energy (S200), determining a state for an associated energy supplying utility, such as a cost of supplying energy from the associated utility (S202), the utility state being indicative of at least a peak demand period or an off-peak demand period (S203). The method further includes operating the clothes washer 110 in a normal mode during the off-peak demand period (S204), operating the clothes washer 110 in an energy savings mode during the peak demand period (S206), selectively adjusting any number of one or more power consuming features/functions of the clothes washer to reduce power consumption of the appliance in the energy savings mode (S208), and returning to the normal mode (S210) after the peak demand period is over (S212).

It is to be appreciated that a selectable override option can be provided on the user interface 116 providing a user the ability to select which of the one or more power consuming features/functions are adjusted by the controller in the energy savings mode. The user can selectively override adjustments, whether time related or function related, to any of the power consuming functions. The operational adjustments, particularly an energy savings operation can be accompanied by a display on the panel which communicates activation of the energy savings mode. The energy savings mode display can include a display of "ECO", "Eco", "EP", "ER", "CP", "CPP", "DR", or "PP" or some other representation on the appliance display 120. In cases with displays having additional characters available, messaging can be enhanced accordingly.

Another load management program offered by an energy supplier may use price tiers which the utility manages dynamically to reflect the total cost of energy delivery to its customers. These tiers provide the customer a relative indicator of the price of energy and in one exemplary embodiment are defined as being LOW (level 1), MEDIUM (level 2), HIGH (level 3), and CRITICAL (level 4). In the illustrative embodiments the appliance control response to the LOW and MEDIUM tiers is the same namely the appliance remains in the normal operating mode. Likewise the response to the HIGH and CRITICAL tiers is the same, namely operating the appliance in the energy saving mode. However, it will be appreciated that the controller could be configured to implement a unique operating mode for each tier which provides a desired balance between compromised performance and cost savings/energy savings. If the utility offers more than two rate/cost conditions, different combinations of energy saving control steps may be programmed to provide satisfactory cost savings/performance tradeoff. The operational and functional adjustments described above, and others, can be initiated and/or dependent upon the tiers. For example, the clothes washer 110 hot water selection can be prevented or 'blocked' from activating if the pricing tier is at level 3 or 4. The display 120 can include an audible and visual alert of pricing tier 3 and 4. Some communication line with the utility can be established including, but not limited to, the communication arrangements hereinbefore described. In addition, the display 120 can provide the actual cost of running the appliance in the selected mode of operation, as well as, maintain a running display of the present cost of energy. If the utility offers more than two rate/cost conditions, different combinations of energy saving control steps may be programmed to provide satisfactory cost savings/performance tradeoff.

Figure 4:
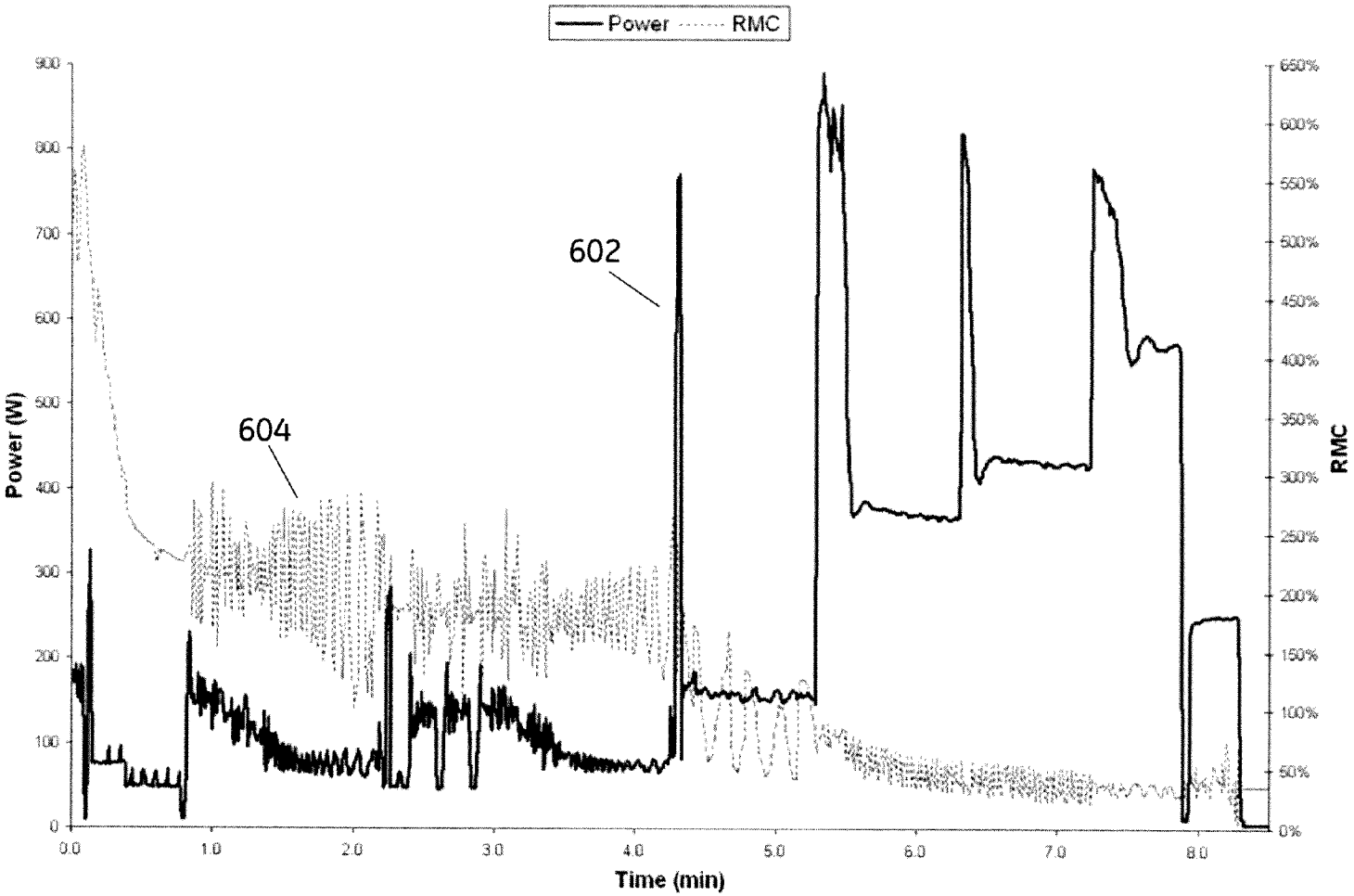
FIG. 4 graphically illustrates the spin profile versus the remaining moisture content in laundry items.
Figure 5:
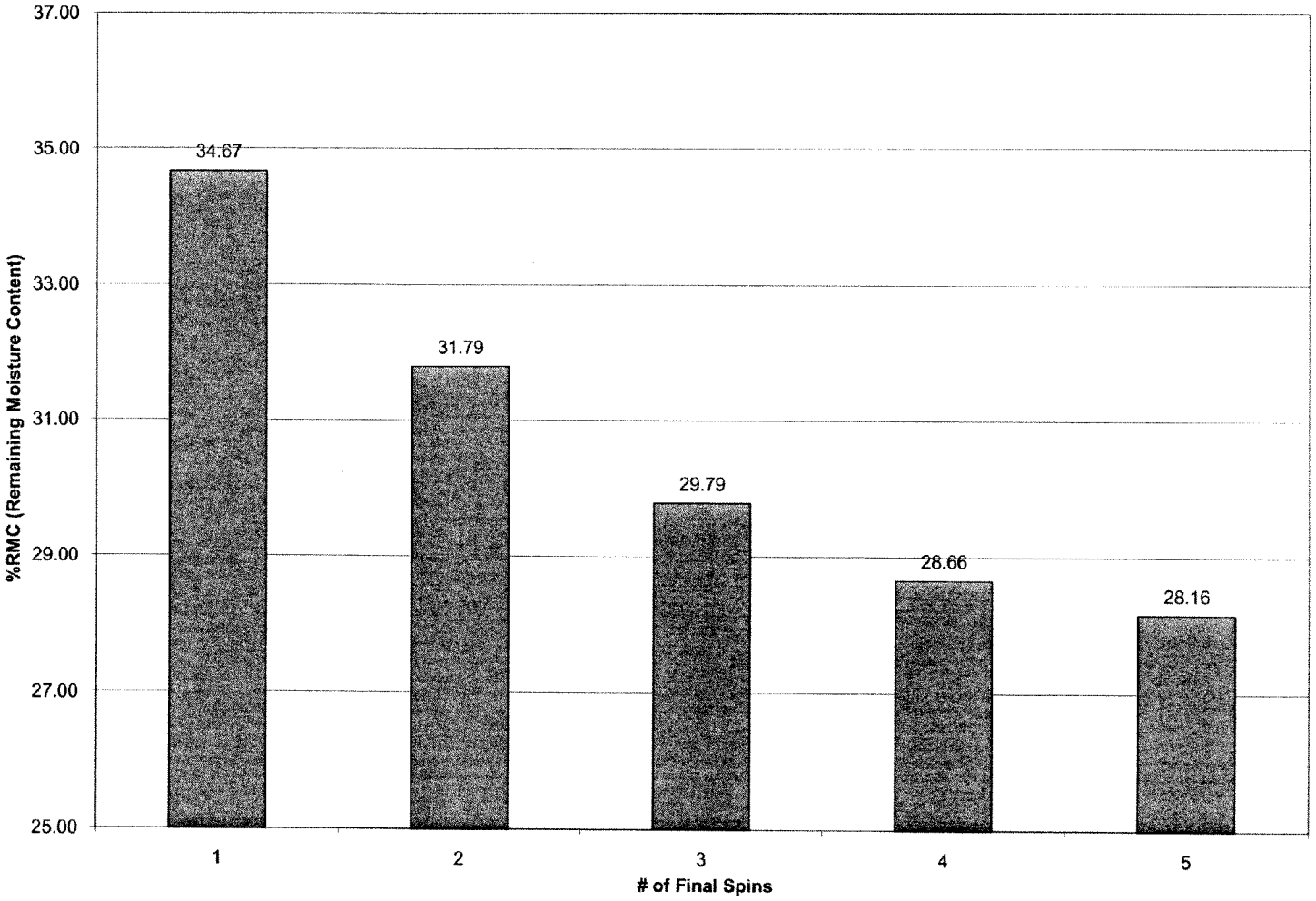
FIG. 5 graphically illustrates the impact of multiple final spins in a clothes washer relative to the remaining moisture content in the laundry articles.

FIGS. 4 and 5 illustrate another potential energy savings for a clothes washer in a peak demand period. For example, energy savings can be achieved by adding one or more spin cycles or extending the period of the spin cycle. Adding one or more spin cycles reduces the moisture content of the laundry articles. Thus, although more energy is used in the clothes washer, the increase in energy is more than compensated for by the energy savings associated with the dryer and the net benefit of both washing and drying is a substantial energy savings. That is, it is much easier to extract water from laundry items in a washing machine rather than remove the moisture by exposing the laundry items to increased temperatures in the dryer. Overall total energy is reduced in the washer and dryer and also a reduced cycle time in the dryer is achieved. Thus, for an incremental increase in energy used by the clothes washer, even more energy is saved in the dryer. It is advantageous to reduce the amount of water, i.e., the remaining moisture content (RMC), of the clothes load introduced into a dryer so that the dryer can work more efficiently and use less energy to dry the clothes. Even one additional final spin can remove significant amounts of moisture from the laundry items.

During a critical price time or peak period, the washer can modify the spin profile to include one or more spin-ups at the end of the cycle which will lengthen the washer cycle time but save energy in the dryer. This arrangement allows for a more economical way to operate the washer and dryer pair during critical or peak pricing events triggered by the local utility, resulting in saving energy and also reduced cost to complete the combined washing and drying cycles.

It is also contemplated that the washer and dryer can communicate with one another so that the dryer operation is adjusted as a result of the reduced moisture content. For example, the dryer may revert or default to moisture content detection for the drying cycle (not a timed period) if an extra spin cycle is added to the wash cycle in the clothes washer.

The reduced moisture content resulting from an additional number of final spins is illustrated in FIGS. 4 and 5. The overall reduction in remaining moisture content levels out after the third spin and thus it is contemplated that at least one additional spin is useful, or multiple spins may be desired with the recognition that there is a limit to the benefits after multiple spins. Likewise, it is recognized that if the peak period signal is received during the middle of a washer cycle, or if the clothes washer is just beginning a wash cycle, then adding the extra spin(s) to the clothes washer to gain the ultimate benefit in the dryer can be easily accomplished. FIG. 4 shows the instantaneous wattage (602) of a typical wash cycle including a single final spin cycle. It also includes a plot of the remaining moisture content (604) of the wash load during the cycle. As seen, the remaining moisture content finishes at roughly 35% which corresponds to the data presented in FIG. 5. Thus, as shown in FIG. 5, a significant reduction in the moisture content is achieved as a result of the controller 104 signaling the motor 118 to extend or add first, second, and third spin cycles to the basket 114 where the remaining moisture content begins to level out.

Once again, the referenced numerical values are exemplary only and one skilled in the art will understand that individual energy savings and average power savings may vary depending on whether one or more of these features are used in combination. Total cost savings will likewise vary depending on the associated energy costs charged by the utility and selections by the homeowner whether to adopt one or more of the demand responses for the clothes washer and/or dryer.

The disclosure has been described with reference to the preferred embodiments. Obviously, modifications and alterations will occur to others upon reading and understanding the preceding detailed description. It is intended that the invention be construed as including all such modifications and alterations.

What is claimed is:

1. An appliance pair, comprising:

a clothes dryer for removing moisture from clothing by exposing the laundry to increased temperatures; and a clothes washer in communication with the clothes dryer, the clothes washer comprising, a housing;

a basket received in the housing;

a motor for selectively moving the basket relative to the housing during a wash cycle; and a controller configured to receive and process a signal indicative of the current cost of a supplied energy, the controller operating the clothes washer in one of a plurality of operating modes including at least a normal mode and an energy savings mode based on the received signal, wherein, during the energy savings mode, the controller changes the operation of the motor to modify a spin profile for the basket to include an additional spin cycle to reduce moisture content of the clothing, and wherein the clothes washer communicates the spin profile to the clothes dryer, and wherein the clothes dryer defines an operating parameter in response to the additional spin cycle in the spin profile of the clothes washer.

2. The appliance pair of claim 1, wherein the controller changes the operation of the motor to include one of a tumbling cycle or an agitation cycle before the additional spin cycle.

3. The appliance pair of claim 2, wherein the tumbling cycle or agitation cycle occurs after completion of a final rinse cycle.

* * * * *